US005101893A

United States Patent [19]

Bilsborough et al.

[11] Patent Number: 5,101,893

[45] Date of Patent: Apr. 7, 1992

[54] HEAT EXCHANGERS

[75] Inventors: Roy Bilsborough, Congleton; Anthreas N. Charcharos, Knutsford, both of England

[73] Assignee: NNC Limited, England

[21] Appl. No.: 524,174

[22] Filed: May 16, 1990

[30] Foreign Application Priority Data

May 22, 1989 [GB] United Kingdom ..... 8911741

[51] Int. Cl.[5] ..... F28D 7/14

[52] U.S. Cl. ..... 165/163; 165/158

[58] Field of Search ..... 122/32, 33; 165/158, 165/163; 376/405

[56] References Cited

U.S. PATENT DOCUMENTS

| | | | |
|---|---|---|---|
| 2,520,755 | 8/1950 | Brown, Jr. | 165/158 |
| 3,155,404 | 11/1964 | Brown, Jr. et al. | 165/158 X |
| 4,136,644 | 1/1979 | Tratz et al. | 122/32 |
| 4,230,527 | 10/1980 | Cella | 176/87 |

FOREIGN PATENT DOCUMENTS

| | | |
|---|---|---|
| 0094732 | 11/1983 | European Pat. Off. . |
| 1197675 | 12/1959 | France . |
| 2128197 | 10/1972 | France . |
| 895912 | 5/1962 | United Kingdom . |
| 1088115 | 10/1967 | United Kingdom . |
| 1142692 | 2/1969 | United Kingdom . |
| 1331134 | 9/1973 | United Kingdom . |
| 1439476 | 6/1976 | United Kingdom . |
| 1444286 | 7/1976 | United Kingdom . |

*Primary Examiner*—Allen J. Flanigan

*Attorney, Agent, or Firm*—Kirschstein, Ottinger, Israel & Schiffmiller

[57] ABSTRACT

In a shell and tube boiler for use, in particular, in a liquid-metal-cooled fast-breeder nuclear reactor, the shell is formed as two vertical side-by-side units joined at their upper ends by a chamber. This "folding" of the unit considerably shortens the overall height of the boiler. Each tube is formed in two sections, each comprising a vertical limb with a curved portion at its upper end. The sections are joined by welding together the ends of the curved portions. This reduces the tube lengths which must be manufactured and transported to the site. In use of the boiler, the liquid sodium level in the chamber is maintained below the level of the tube welds. The chamber region above the sodium level may be filled with a blanket gas, such as argon.

11 Claims, 2 Drawing Sheets

HEAT EXCHANGERS

BACKGROUND OF THE INVENTION

1. Field of the Invention

This invention relates to heat exchangers and particularly to heat exchangers of the type comprising a bundle of tubes contained within an outer shell.

2. Description of Related Art

Such heat exchangers are used, for example, as "once-through" steam generators in liquid metal cooled fast breeder nuclear reactor power plant. In such plant, a liquid alkali metal, such as sodium, heated by the nuclear reaction, is passed through the shell in contact with the outer surface of the tubes, while water is passed through the tubes. The water is vapourised thereby, and the steam generated is used to drive one or more turbine-generator units.

A schematic sectional view of a conventional steam generator unit for a liquid metal cooled fast breeder reactor (LMCFBR) is shown in FIG. 1 of the accompanying drawings. The unit comprises a straight elongate vertical shell 1 extending between a feed water inlet header 2 and a steam outlet header 3. The header 2 has a water inlet nozzle 4 and the header 3 has a steam outlet nozzle 5. A bundle 6 of vertical tubes conducts water and steam from the header 2 to the header 3. For the sake of clarity, only the outline of the bundle is shown as two chain-dotted lines. The tubes extend between a tubeplate 7 in the header 2 and a tubeplate 8 in the header 3, and are welded at their respective ends to the tubeplates. The bundle 6 of tubes is enclosed within a cylindrical shroud 9, and is supported by horizontal grid plates 10, spaced apart over the length of the shroud.

Liquid sodium is fed into the shell 1 via an inlet nozzle 11, passes through an annular chamber 12 and a distribution grid 13 and enters the interior of the shroud 9. The sodium flows downwards within the shroud in thermal contact with the tubes, passing through the grid plates 10. The major part of the sodium flow leaves the shroud via apertures in an outlet section 14, enters an annular chamber 15 and then leaves the shell 1 via an outlet nozzle 16. The remainder of the liquid sodium flow is conducted downwards through grids 17, 18, 19 to act as a thermal barrier to protect the tubeplate 7. The shell may include a bellows device 20 to allow for differential expansion of the shell and the tubes.

This conventional type of steam generator unit suffers from a number of disadvantages. Firstly, the straight shell and tube configuration requires the bellows device to give tolerance to tube-shell temperature differences. Secondly, the configuration has poor tolerance to temperature differences between the tubes. Thirdly, it is very long (for example approximately 37 meters), and this gives rise to a number of problems. Thus, the building in which it is housed must be very high, manufacture, transport and erection of the unit are difficult and, more especially, the tubes must be in continuous lengths, because sub-sodium tube to tube welds are considered undesirable. Furthermore, the plant required to draw tubes of the full heat exchanger length and to heat treat them would involve very considerable capital expenditure.

Some of these problems have been alleviated in some known heat exhangers, such as shown in British Patent Specification No: 1,088,115, by forming the tube-in-shell arrangement into an inverted-U configuration, thereby reducing the overall height of the heat exchanger.

However, the above-mentioned prior specification discloses the use, in a boiler feedwater heater, of tubes formed in continuous lengths, so the overall tube lengths which have to be manufactured are large. It is not suggested therein that the tubes should be formed in shorter lengths which are then welded together during assembly of the heat exchanger.

SUMMARY OF THE INVENTION

It is an object of the present invention to provide an improved heat exchanger.

According to the invention there is provided a heat exchanger of the type comprising a group of substantially parallel elongate tubes for conducting a flow of a first material, and an elongate outer shell containing said tubes and arranged to receive a flow of a second material around the tubes to enable exchange of heat between said first and second materials; wherein said outer shell comprises first and second substantially vertical elongate shell portions and an upper chamber interconnecting the shell portions; and wherein each tube comprises first and second tube portions each comprising a substantially vertical limb and an upper portion, the upper portions of the first and second tube portions being joined to form an inverted U-shaped region within the chamber, the vertical limbs being contained in said first and second shell portions, respectively; and wherein, in use of the heat exchanger, said second material is maintained at a level within the chamber, which level is below the points of joining of the upper tube portions.

BRIEF DESCRIPTION OF THE DRAWINGS

An embodiment of the invention will now be described, by way of example, with reference to the accompanying drawings, in which.

DETAILED DESCRIPTION OF THE PREFERRED EMBODIMENT

Figure 1:
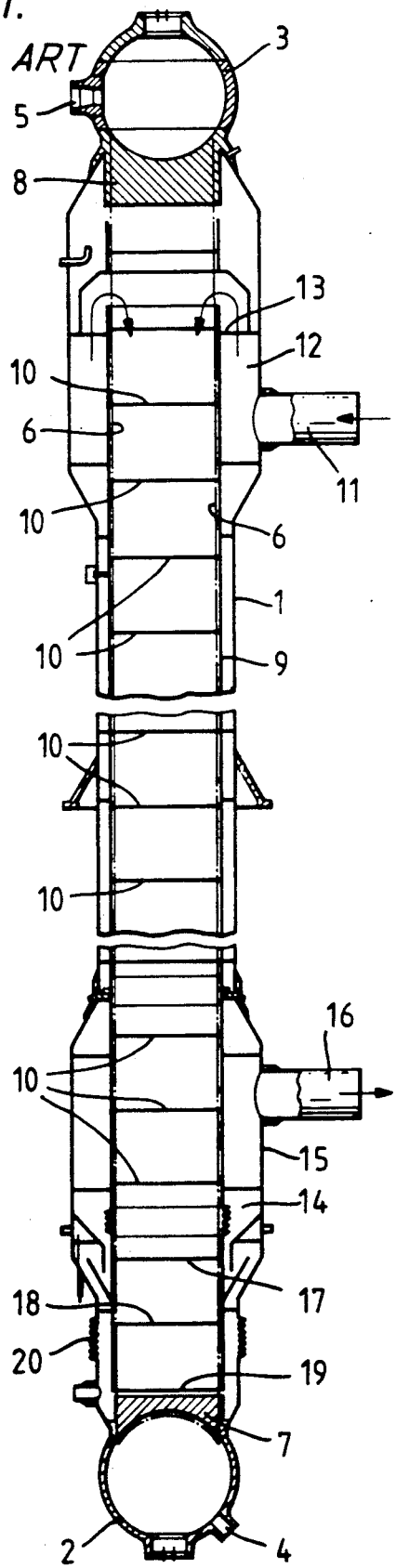
Fig. 1. PRIOR ART
FIG. 1 is a schematic sectional view of a conventional steam generator as described above in accordance with the prior art.
Figure 2:
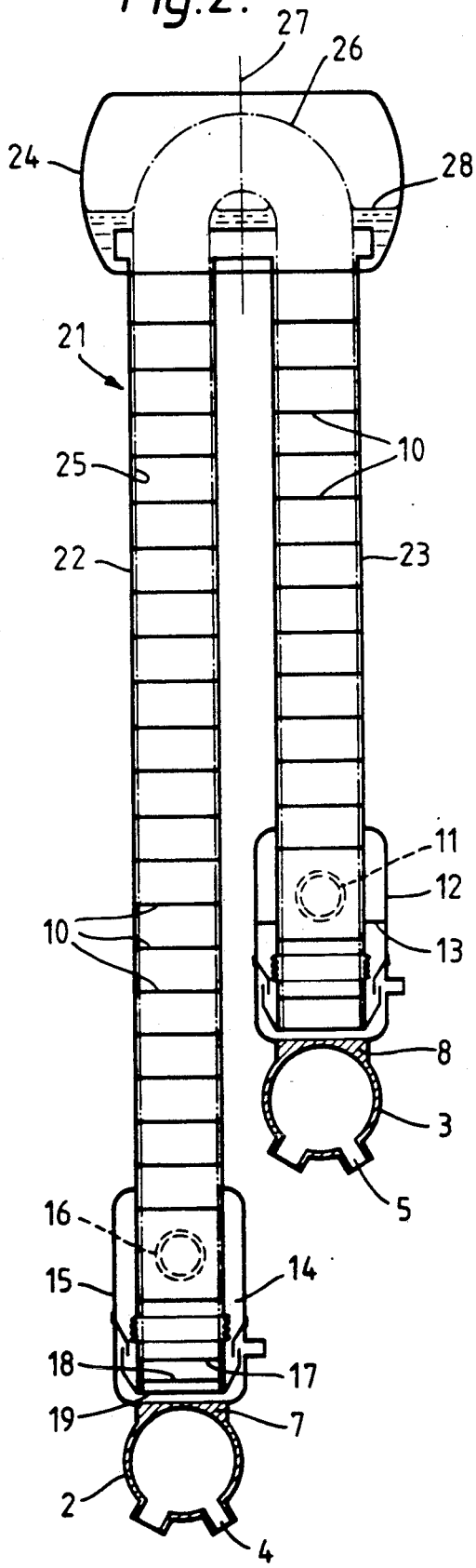
FIG. 2 is a schematic sectional view of a steam generator in accordance with the invention.

Referring to FIG. 2, in which components serving the same purpose as those in FIG. 1 have the same reference numerals, a shell 21 comprises two parallel side-by-side elongate sections 22 and 23 interconnected by a chamber 24 to which the sections are sealed. The steam outlet header 3 is now at the lower end of the shell section 23. Similarly, the sodium inlet nozzle 11, the annular chamber 12 and the distribution grid 13 are now adjacent the lower end of the shell section 3. The sodium inlet and outlet nozzles 11, 16 are now preferably moved round their respective chambers by 90°, so that they extend perpendicular to the plane of the axes of the two shell sections. This allows for more convenient installation.

Each tube in a bundle 25 now comprises two limbs, one contained in each of the shell sections, the limbs being interconnected at their upper ends by an inverted U-shaped tube region 26. The region 26 is preferably formed by bending the upper end of each tube limb through 90° and butt welding the ends of each two associated limbs together so that in the assembled tube bundle the welds all lie substantially in a plane 27.

In use of the steam generator unit in accordance with the invention the liquid sodium is maintained at a level 28 in the chamber 24, which level lies below the lowest point of the tube welds. Hence, the welds are not submerged in the sodium. The space above the sodium level 28 is filled with a blanket gas, such as argon. This gas can be used for detecting leakage from the tubes at the weld area.

Within the chamber 24, the bent tube sections are above the sodium level 28 and are therefore substantially free from significant dynamic excitation. It may therefore not be necessary to provide grid plates for supporting the tubes over those sections. The fact that the tube bends are unsupported, and therefore relatively flexible, means that there is large tolerance to differential tube/tube and tube/shell thermal expansion.

The shell sections 22, 23 are shown as being of unequal lengths. However, each can be of any desired length. One section might be sufficiently long to carry out economising and evaporation duties, and the other to carry out the superheating duty.

The "folded" configuration of the steam generator unit according to the invention provides a number of very important advantages over the conventional straight configuration.

Firstly, the overall height of the unit can be much shorter, for example 24 meters as compared with a conventional 37 meter unit. The building to house the unit can be correspondingly lower. Furthermore, aseismic design is eased by the reduced height, and sodium feed and steam pipework can be shorter. The cost of the installation is therefore reduced.

Secondly, the configuration permits "upward boiling", which is advantageous because it tends to be hydrodynamically stable at low loads and at start up conditions.

Thirdly, the tube lengths which must be manufactured and transported are much shorter. Similarly the shell and the shroud are each formed in relatively short sections which are readily joined to the chamber 24, again reducing the cost and difficulty of manufacture and the difficulty of transportation. In a conventional unit the butt welding of tubes would not be acceptable, because the welds would lie within the liquid sodium. In the present configuration the welding of tube sections is satisfactory because the welds lie above the sodium level and within a gas space. The gas can be used for tube leak detection.

Fourthly, the greater flexibility provided by the inverted U-bends gives greater tolerance to differential thermal expansions, and also to dimensional variations during assembly and during the welding of the tubes to the tubeplates.

Although in the embodiment described above the heat exchanger is a steam generator unit for an LMCFBR, it will be apparent that the invention may be applied to heat exchangers for use in other applications.

We claim:

1. A heat exchanger of the type comprising a group of substantially parallel elongate tubes for conducting a flow of a first material, and an elongate outer shell containing said tubes and arranged to receive a flow of a second material around the tubes to enable exchange of heat between said first and second materials; said outer shell comprising first and second substantially vertical elongate shell portions and an upper chamber interconnecting said shell portions; and each tube comprising discrete first and second tube portions each comprising a substantially straight vertical limb and a curved upper portion, said upper portions of said first and second tube portions being directly joined to each other to form an inverted U-shaped region within said chamber, said vertical limbs being contained in said first and second shell portions, respectively; wherein, in use of the heat exchanger, said second material is maintained at a level within said chamber, which level is below the points of joining of said upper tube portions.

2. A heat exchanger as claimed in claim 1, wherein said upper portions are joined by welding.

3. A heat exchanger as claimed in claim 1, wherein each said vertical limb is supported within its corresponding shell portion by a plurality of transverse support members spaced apart in the longitudinal direction of said shell portion; and wherein said U-shaped regions are unsupported within said chamber.

4. A heat exchanger as claimed in claim 1, wherein said tubes conduct water therethrough and wherein said outer shell receives liquid sodium around the tubes.

5. A heat exchanger as claimed in claim 1, wherein said chamber has a region above the level of said second material that is filled with a blanket gas.

6. A heat exchanger as claimed in claim 5, wherein said blanket gas is argon.

7. A heat exchanger for use in a liquid metal cooled fast breeder reactor, said heat exchanger comprising a group of substantially parallel elongate tubes for conducting a flow of water, and an elongate outer shell containing said tubes and arranged to receive a flow of a liquid metal around the tubes to enable exchange of heat between said water and said liquid metal; said outer shell comprising first and second substantially vertical elongate shell portions and an upper chamber interconnecting said shell portions; and each tube comprising discrete first and second tube portions each comprising a substantially straight vertical limb and a curved upper portion, said upper portions of said first and second tube portions being welded together to form an inverted U-shaped region within said chamber, said vertical limbs being contained in said first and second shell portions, respectively; wherein, in use of the heat exchanger, said liquid metal is maintained at a level within said chamber, which level is below the points of welding of said upper tube portions.

8. A heat exchanger as claimed in claim 7, wherein each said vertical limb is supported within its corresponding shell portion by a plurality of transverse support members spaced apart in the longitudinal direction of said shell portion; and wherein said U-shaped regions are unsupported within said chamber.

9. A heat exchanger as claimed in claim 7, wherein said outer shell receives liquid sodium around the tubes.

10. A heat exchanger as claimed in claim 7, wherein said chamber has a region above the level of said second material that is filled with a blanket gas.

11. A heat exchanger as claimed in claim 10, wherein said blanket gas is argon.

* * * * *